United States Patent [19]

Gaudin et al.

[11] Patent Number: 5,028,320

[45] Date of Patent: Jul. 2, 1991

[54] SEWER CATCH BASIN WITH GAS SEAL FOR A PETROLEUM REFINERY OR CHEMICAL PROCESSING PLANT

[76] Inventors: Carl J. Gaudin, P.O. Box 74823, Baton Rouge, La. 70874; Larry G. Lacouture, 17134 Sharpsburg Ave., Baton Rouge, La. 70817

[21] Appl. No.: 445,494

[22] Filed: Dec. 4, 1989

[51] Int. Cl.[5] ..... F16K 13/02; E03F 5/08

[52] U.S. Cl. ..... 210/164; 52/20; 137/247.11; 404/25; 210/248; 210/238

[58] Field of Search ..... 52/19–21; 210/164, 165, 163, 460, 248, 238, 239; 404/25, 26; 137/247, 247.11

[56] References Cited

U.S. PATENT DOCUMENTS

| | | | |
|---|---|---|---|
| 129,246 | 7/1872 | Ober | 210/164 |
| 417,441 | 12/1889 | Reader | 210/164 |
| 543,617 | 7/1895 | Dunstan | 210/164 |
| 780,572 | 1/1905 | McQuistion | 210/164 |
| 818,164 | 4/1906 | Hannagan | 210/164 |
| 835,852 | 11/1906 | Farley | 137/247.23 |
| 1,070,773 | 8/1913 | Callahan | 210/164 |
| 1,469,790 | 10/1923 | Hysko | 137/247.23 |
| 1,507,531 | 9/1924 | Vaudell | 210/164 |
| 1,686,415 | 10/1928 | Lyes | 210/164 |
| 2,095,024 | 10/1937 | Boosey | 182/31 |
| 2,101,978 | 12/1937 | Boosey | 182/31 |
| 2,497,577 | 2/1950 | Biggerstaff | 182/31 |
| 2,783,852 | 3/1957 | Sisk | 182/31 |
| 3,516,541 | 6/1970 | Hardingham | 210/164 |
| 3,556,993 | 1/1971 | Persson | 210/164 |
| 3,621,623 | 11/1971 | Downes | 53/20 |
| 3,712,008 | 1/1973 | Campagna | 52/20 |
| 3,712,009 | 1/1973 | Campagna | 52/20 |
| 3,713,539 | 1/1973 | Thompton | 210/164 |
| 4,045,346 | 8/1977 | Swaskey | 210/164 |
| 4,243,068 | 1/1981 | Sugda et al. | 52/21 |
| 4,305,679 | 12/1981 | Modi | 404/25 |
| 4,419,232 | 12/1983 | Arntyr | 210/164 |
| 4,682,907 | 7/1987 | Gaudin | 404/25 |
| 4,776,722 | 10/1988 | Gaudin | 404/25 |
| 4,919,564 | 4/1990 | Neathery et al. | 404/25 |

FOREIGN PATENT DOCUMENTS

| | | | |
|---|---|---|---|
| 2803959 | 8/1979 | Fed. Rep. of Germany | 210/164 |
| 3620132 | 9/1987 | Fed. Rep. of Germany | 210/164 |
| 38641 | 6/1931 | France | 210/164 |
| 1114847 | 9/1984 | U.S.S.R. | 137/247 |

*Primary Examiner*—W. Gary Jones
*Assistant Examiner*—Joseph Drodge
*Attorney, Agent, or Firm*—David L. Ray

[57] ABSTRACT

A sewer catch basin assembly for preventing gases from being discharged from a sewer of a petroleum refinery or chemical processing plant and for preventing the ignition of gases in a sewer by flames and sparks in the area adjacent to the sewer inlet. The catch basin assembly may be connected to a vertical pipe or "Tee" inserted in an existing or new horizontal sewer pipe, and can be used to replace an existing sewer inlet or catch basin. The catch basin assembly provides a water barrier between gases contained in the sewer and the ambient air adjacent to the sewer inlet which prevents the flow of gases from the sewer to the ambient air surrounding the sewer inlet.

10 Claims, 2 Drawing Sheets

SEWER CATCH BASIN WITH GAS SEAL FOR A PETROLEUM REFINERY OR CHEMICAL PROCESSING PLANT

BACKGROUND OF THE INVENTION

1. Field of the Invention

The present invention is related to an apparatus for preventing explosive and environmentally hazardous vapors contained in a sewer from being transmitted to the atmosphere surrounding the sewer. More particularly, the present invention relates to sewer catch basins which protect the environment by preventing explosive vapors and noxious gases contained in a sewer from escaping into the atmosphere surrounding the sewer catch basin or inlet and causing explosions or polluting the environment.

2. Description of the Prior Art

Industries which manufacture and process flammable liquids and gases such as hydrocarbons have difficulty in keeping the hydrocarbons and other flammable or environmentally hazardous liquids from finding their way into the sewer system located beneath the manufacturing facility. Once in the sewer, the gases can escape from the sewer system into the atmosphere surrounding the sewer system to pollute the environment and/or create an explosion hazard. Flammable liquids and gases in such sewer systems can be easily ignited by welding or cutting operations occurring in the vicinity of the inlets to the sewer system, and cause serious explosions. Furthermore, gases escaping from the sewer can pollute and contaminate the environment to the extent that human health is endangered.

Such problems are commonly encountered in the petroleum refining industry. In most petroleum refining facilities elaborate systems are used to recover hydrocarbons in the sewer system for processing into useful product.

Hydrocarbons and other flammable liquids and gases are frequently present in the sewer systems of petroleum refiners, and precautions must be taken when performing burning and welding in the facility of sewer inlets. Commonly, the sewer inlet is covered with a vinyl coated canvas having a border filled with sand or sawdust to prevent flammable gases in the sewer from being ignited by burning or welding operations in the refinery. The vinyl cover has a reservoir to retain water which adds weight to the interior of the cover to improve the seal over the inlet. The area immediately surrounding a sewer inlet may be gravel or dirt, but in most cases the surrounding area is either asphalt or concrete.

When the area surrounding a sewer cover is asphalt or concrete it is extremely difficult to seal the perimeter of the sewer cover, even using a vinyl coated canvas cover filled with water, sand and/or sawdust. In addition to placing the sewer cover over the inlet or man way and filling it with water, sand must be placed around the outside of the border to aid in sealing the sewer inlet from the surrounding area. Such a seal is necessary to prevent flammable gases from escaping from the sewer inlet and to keep sparks from burning and welding operations from entering the sewer system and igniting flammable gases therein.

Commonly, in a petroleum refinery while burning or welding is in progress, a water spray is directed toward the sparks generated by the burning and welding to cool the metal being welded or cut and to cool any molten pieces of metal falling from the work area. Canvas blankets are sometimes placed around the site of the burning or welding while the burning or welding is in progress, and a water spray is directed to the exterior of the canvas blankets to prevent sparks from entering the sewer and coming into contact with flammable liquids or gases in the sewer.

Such measures provide minimal protection from explosion and/or fires in the sewer systems of petroleum refiners and other chemical processing plants. The perimeter of the sewer cover even when covered with sand may still allow flammable gases and hot sparks to come into contact with each other, even though canvas blankets may be placed around the site of the cutting or welding.

U.S. Pat. No. 4,776,722 discloses a self sealing sewer cover assembly comprising a cover assembly which may replace or be used in combination with an existing cover or grating on a sewer inlet and may be inserted into the inlet to a sewer. The apparatus provides a water barrier between gases contained in the sewer and the ambient air adjacent to the sewer inlet which prevents the flow of gases from the sewer to the ambient air surrounding the sewer inlet. The apparatus includes an insert means having a top end and a bottom end for connection to a sewer inlet having generally vertical interior walls, the insert means having generally vertical walls on the exterior thereof for parallel alignment with the generally vertical interior walls of the sewer inlet, a trough connected to the bottom end of the insert and extending completely around the interior of the vertical walls of the insert for containing water, the trough having an inner, generally vertical wall defining an opening through which water overflowing from the trough can flow, the inner, generally vertical wall of the trough having a height less than the height of the generally vertical wall of the insert, a removable screen assembly for collecting trash adapted to fit inside the insert and over the trough, a lid lying in trough, and over and around the opening to prevent gases from traveling through the opening when the trough is filled with water while permitting liquids to flow through the opening, and a cover lying on top of the insert, the cover having a plurality of channels therein through which liquids may flow.

U.S. Pat. No. 4,682,907 discloses a self sealing sewer cover assembly comprising a cover assembly which may replace or be used in combination with an existing cover or grating on a sewer inlet and may be inserted into the inlet to a sewer. The apparatus provides a water barrier between gases contained in the sewer and the ambient air adjacent to the sewer inlet which prevents the flow of gases from the sewer to the ambient air surrounding the sewer inlet. The apparatus includes an insert means having a top end and a bottom end for connection to a sewer inlet having generally vertical interior walls, the insert means having generally vertical walls on the exterior thereof for parallel alignment with the generally vertical interior walls of the sewer inlet, a trough connected to the bottom end of the insert and extending completely around the interior of the vertical walls of the insert for containing water, the trough having an inner, generally vertical wall defining an opening through which water overflowing from the trough can flow, the inner generally vertical wall of the trough having a height less than the height of the generally vertical wall of the insert, a removable screen assembly for collecting trash adapted to fit inside the insert and over the trough, a lid lying in the trough, and over and around the opening to prevent gases from traveling through the opening when the trough is filled with water while permitting liquids to flow through the opening, and a cover lying on top of the insert, the cover having a plurality of channels therein through which liquids may flow.

U.S. Pat. No. 4,419,232 discloses a filtering and collecting device for water drains having a outer drain grating for preventing accidents and for preventing coarse material from falling into the drain. The device is intended for separating and collecting particular impurities such as sand, wooden pegs and leaves, and also oil and other liquid impurities passing through the grating. The device includes a holder ring intended to be mounted under the drain grating, and carrying the combination of a coarse-filtering and protecting means and a fine-filtering means. The coarse-filtering and protecting means is cup shaped and arranged in the holder ring, while the fine-filtering means includes a filter bag of a flexible and water-permeable cloth or fabric material arranged around the holder ring. The holder ring is preferably funnel-shaped and provided with a mounting flange arranged to be firmly clamped beneath the drain grating, and the coarse-filtering means comprises preferably a wire basket.

U.S. Pat. No. 4,305,679 discloses a man hole sealing device to prevent water from entering a man hole through the corbel joint between the man hole casing and the cover frame. The cover disclosed completely seals a man hole. Such a device would not be pertinent to the present invention in which water flow into a sewer is permitted rather than completely stopped.

U.S. Pat. No. 4,045,346 discloses a basement sewer trap comprising a coupling sleeve for a sewer pipe having an interior cup or well, the interior of the cup supporting a funnel tube beneath a water strainer. The water flows through the strainer, down through the funnel tube, upward out of the cup portion, and finally down the open end of the coupling sleeve into a sewer pipe.

U.S. Pat. No. 3,713,539 discloses a strainer device for use in drainage receptacles such as floor sinks, roof drains and the like. The strainer device is removably mounted adjacent to the upper portion of the drainage receptacle and is adapted to captively retain foreign material entering therein. The strainer device includes a perforated plate having four laterally disposed side edges which rests upon the radiused juncture of the drainage receptacle to position the plate flush with the upper surface of the flange, a strainer basket which includes a flat rigid four sided frame, and a pair of channel elements affixed to the lower surface of the plate, each of the channels parallel with and adjacent to a different one of an opposing pair of the side edges of the plate for positioning the channels in a spaced apart parallel relationship, each of the channels having an inwardly facing lip formed on the lower portion thereof upon which an opposing pair of the side edges of the strainer basket are slidably supportingly positioned for demountably suspending the strainer basket in a mounted position adjacent to the lower surface of the plate, each of the channels biased upwardly to engagingly contact the inner surface of the receptacle body to removably retain and stabilize the plate when it is mounted flush with the flange thereof.

U.S. Pat. No. 3,712,009 discloses a manhole closure assembly with valve relief means for preventing drainage and storm water from emptying into a manhole leading to a sewerage system. A closure assembly comprises a cover plate sealing off a manhole opening. A first valve is secured to the cover plate for relieving pressure inside the manhole when pressure therein reaches a predetermined amount, and a second valve member which is secured to the cover plate for relieving vacuum inside the manhole when vacuum therein exceeds the predetermined amount.

U.S. Pat. No. 3,621,623 discloses an apparatus for temporarily closing an opening formed at the top of a vertical wall of a catch basin, man hole or the like, the man hole arrangement employing a trough type member 32 having a removable lid 31 is disclosed in FIG. 6. However, the lid completely closes the man hole and does not allow any flow therethrough, whereas in the present invention it is necessary to have fluid flow through the sewer cover.

U.S. Pat. No. 3,556,993 discloses a surface drain with water trap which is, flush with the surface having a trap within the sump of the drain, formed by an easily removable baffle and a means whereby surface water that does go through a grid set in the top of the drain is passed into the sump by virtue of a recess around the perimeter of the grid between the grid and drain casing where a surface covering material can terminate so that liquid seeping past the grid can flow over the baffle lip or top and thence into the sump.

U.S. Pat. No. 3,516,541 discloses a drain device comprising a prefabricated structure that may be removably mounted in a vertical drain structure which when partially filled with water provides a seal to prevent upward discharge of explosive vapors through the drain structure into the ambient atmosphere. The structure disclosed therein comprises a first cylinder open at the top and bottom contained within a second outer cylinder having a series of holes therein through which water flowing downwardly through the first cylinder and outwardly from the bottom of the first cylinder may exit.

U.S. Pat. No. 2,783,852 discloses a surface drain for use in floors of shower bath enclosures, roadways, decks of ships and the like to provide debris-excluding protection at the inlets of drain openings or pipes. The invention includes a drain structure having a peripheral slot whose outer edge is vertically aligned with or substantially so with the inner surface of the drain body. This slot is effective througout the periphery of the drain body inlet, and the internal surfaces of the drain body extend from this slot downwardly to the drain outlet, or to the inlet of the drain pipe on which the drain body is mounted, affording a clear unrestricted down sweep for the flow of the draining water. No ledges, channels or crevasses suppress this structure, in which debris may accumulate.

U.S. Pat. No. 2,497,577 discloses a floor drain and cover therefor including a drain pipe, a cup-like trap secured to the upper end portion of the drain pipe, the trap including an upstanding annular rim, the upper end of the rim being provided on its inner peripheral surface with an endless groove constituting an annular cover supporting ledge, and a circular cover having its marginal edge portion seated on said ledge with its upper surface flush with the upper edge of said rim, the upper end of the drain pipe extending into the cup and terminating on a plane below the underside of the cover, and the cover having integral upper central depending coupling telescoping into the upper end of the drain pipe and provided with an aperture and shouldered portion, the shouldered portion resting on the upper end of the drain pipe.

U.S. Pat. No. 2,101,978 discloses a floor drain having a drain body with an open upper end and an outlet at the bottom, a grating supported at the upper end, a sediment intercepting trap including a basket supported centrally in relation to the grating and of less area than the grating, a skirt depending from the grating into the basket and having a open lower end, the basket having apertures in its wall above the lower most point of the skirt and providing for a flow of materials from the basket into the drain body, the grating having a series of apertures within the area defined by the skirt, and a series of apertures outside the area of the skirt providing for a flow of liquids through the grating into the drain body, the combined area of the last named apertures being less than the combined area of the apertures opening to within the skirt.

U.S. Pat. No. 2,095,024 discloses a floor drain having an inward extending flange near the top, a sediment intercepting basket supported on the flange and having a tubular portion extending vertically through the basket, the upper end of the sediment intercepting basket being provided with a shoulder, a grating mounted on said shoulder, the grating having a perforated central portion over the upper end of the tubular portion of the sediment intercepting basket and the grating also being provided with openings arranged about said perforated central portion, an annular flange about the exterior of the drain body, a clamping ring having an angular face corresponding to the face of the angular flange and a series of adjusting screws supported on the exterior of the drain body and engaging the clamping ring, the drain body being provided with seepage apertures through the wall above the connection of the angular flange with the drain body.

U.S. Pat. No. 1,686,415 discloses a trap for drains and sewers including a container having an opening in the side wall thereof, a funnel-shaped device extending into the container below the opening thereof, providing a water seal, an upwardly and outwardly flared element projecting from the upper edge of the funnel and offset from the wall of the funnel to provide an inwardly extending portion, and a dished member receiving the flared element and having a flange for engaging the container at a point below the inwardly extending portion of the flared element.

U.S. Pat. No. 1,507,531 discloses a trap for a sewer pipe comprising an outer casing having an opening in the bottom thereof to receive the pipe means for connecting the casing with the pipe with the latter terminating an appreciable distance below the upper edge of said casing, an inner casing arranged within the outer casing and slightly spaced therefrom, the inner casing having an opening in the bottom thereof and formed with a central tubular portion which receives the pipe, an inwardly and downwardly extended flange formed on the upper end of the tubular portion and utilized and extended into the upper end of the pipe to support the casing, the tubular portion being of a larger diameter than the pipe and spaced therefrom, a cover for the outer casing, a rod depending from the cover, and a dome shaped member supported by the rod and surrounding the adjacent end of said pipe and tubular portion of the inner casing.

U.S. Pat. No. 1,469,790 discloses a sell trap floor drain including a cylindrical casing flanged at one end and having a tapered opening therein, a ball valve in said casing, a flanged cylindrical trap member having a central depending portion tapered exteriorly for seating engagement with the tapered opening of said casing and interiorly tapered for seating engagement with said ball valve, and tie members interconnecting the flanges of said valve case and trap member for retaining said members engaged.

U.S. Pat. No. 835,852 discloses a dry pan floor drain, the pan having a tubular radial projection provided at its end with a depending flange and with an upper transverse outwardly-projecting flange, a trap fitting against the tubular projection flange of the same and having a depending flange fitting against the depending flange of said tubular projection, a U-shaped plate clamped by and between the depending flanges of the trap and the tubular projection of the pan and fitting against the upper side of the upper transverse flange of said tubular projection, and an outwardly-opening valve-gate hinged to the upper portion of said U-shaped plate.

U.S. Pat. No. 818,164 discloses a cover and trap for catch basins and the like including a central wall or pipe, an inverted top or cup having a downturned shell or flange to forma water seal for said central wall or pipe, separated projections at the top of said central wall or pipe serving as supports for the said top or cup, and ribs or lugs serving to prevent horizontal movement of the said top or cup.

U.S. Pat. No. 780,572 discloses a water trap including an inverted siphon having a discharge-limb shorter than the intake-limb, an air-chamber connected with the upper end of the discharge-limb having a capacity greater than that of the discharge-limb, and connecting the latter with the sewer, and a vent-pipe connected with and extended downwardly into said air-chamber.

U.S. Pat. No. 543,617 discloses a stench trap including a bowl shaped casing having its lower end contracted to be fitted into a sewer or waste pipe, and having an interior annular groove 4 at its top, and having ribs 10 integral with and projecting from its inner side and compoundly curved on their inner edges, a sealing owl 11 having imperforate bottom and sides and removably supported with in the casing upon the said ribs, a handle secured centrally to the sealing bowl and extending above the top edge thereof, and a flat perforate cap removably fitted within the upper end of the casing and provided with an integral depending flange fitting within the said interior groove 4, and having an integral depending inverted trunco-conical neck projecting into the sealing bowl below the plane of its upper edge, substantially as and for the purpose described.

U.S. Pat. No. 530,816 discloses a manhole for sewers including a open ended metal casing or lining for manholes formed near its upper end with an offset D, and a second offset C thereabove, the upper horizontal wall or flange of which is provided with slots F in its inner edge, of the open work cover resting on said flange and having radial pins E passed down through slots F and engaging the under side of said flange, and the mud pan E of less diameter than the casing and having radial pins G resting on the shoulder formed by the offset D.

U.S. Pat. No. 417,441 discloses a sink trap including a sink provided with a well and waste-pipe extended upwardly into the well of a strainer adapted to extended over the upper end of said well and having a downwardly-extending tube or pipe of greater diameter than the waste-pipe and into which said waste-pipe extends, said tube or pipe being provided near its lower end with apertures for the passage of water, and with a horizontally-extending flange of substantially the same diameter as the interior of said well, substantially as specified.

U.S. Pat. No. 129,246 discloses a cover "E" which is placed on the cap ring of the mouth of a water pipe gate and two other covers "GG" which are placed over pyramidal or conical sections to form a dead air space therebetween.

French Patent No. 38,641 discloses a drainage system in a floor or ceiling having an outflow unit with an open-topped cylindrical inflow space partitioned from a drainpipe by an odour lock comprising overflow baffle overlapped by a plunger bell. An insert piece carrying the inflow grating is height-adjustably checked on the inflow unit, and sealed by a ring in the inflow space. The sealing ring (15) is set lower than the overflow baffle (4) on the odour lock. The top edge (12) of the outflow unit (1), determing the height for building-in, lies at the same height of the overflow baffle, or slightly lower. This enables a lower runoff to be used.

German Patent No. 28 03 959 discloses a sewer inlet including a fixed casing with an outlet pipe penetrating through the bottom, and a height-adjustable frame into which is placed the inlet grid. The grid (3) carries on its underside a journal (6) which extends into a chamber (11) at the top of the odour seal bell (5). The bell is held, so as to be height-adjustable, to the journal by means of a clamping device (8, 9) provided near the end of the journal.

SUMMARY OF THE INVENTION

In accordance with the present invention there is provided a sewer catch basin for preventing gases from being discharged from a sewer and for preventing the ignition of gases in a sewer by flames and sparks in the area adjacent to the sewer inlet. The cover assembly may be connected to a vertical pipe or "Tee" inserted in an existing or new horizontal sewer pipe, and can be used to replace an existing sewer inlet or catch basin. The apparatus of the present invention provides a water barrier between gases contained in the sewer and the ambient air adjacent to the sewer inlet which prevents the flow of gases from the sewer to the ambient air surrounding the sewer inlet.

The sewer catch basins of the present invention keep the sewer sealed at all times to prevent noxious gases in the sewer from escaping into the environment and prevent any flames or sparks outside of the sewer inlet from igniting gases contained in the sewer. Furthermore, the present invention permits easy viewing and inspection of the liquid level in the assembly to be certain a gas seal is being maintained by viewing the liquid level through the holes in the cover or by lifting the cover to view the liquid level.

The cover assemblies of the invention are low in cost and easily installed in existing sewer inlets or in new sewer systems.

By utilizing the catch basins of the invention made from steel or other high strength metals, concrete catch basins which crack easily and leak liquids into the earth surrounding the basin can be eliminated.

The catch basins of the invention reduce solids or particulate buildup in sewer systems from ground erosion in unpaved areas and during maintenance by eliminating the use of sand and dirt to cover and seal catch basins.

Furthermore, the catch basins of the invention reduce the volume present in the basin in which dangerous gas could accumulate.

DESCRIPTION OF THE PREFERRED EMBODIMENTS

Figure 1:
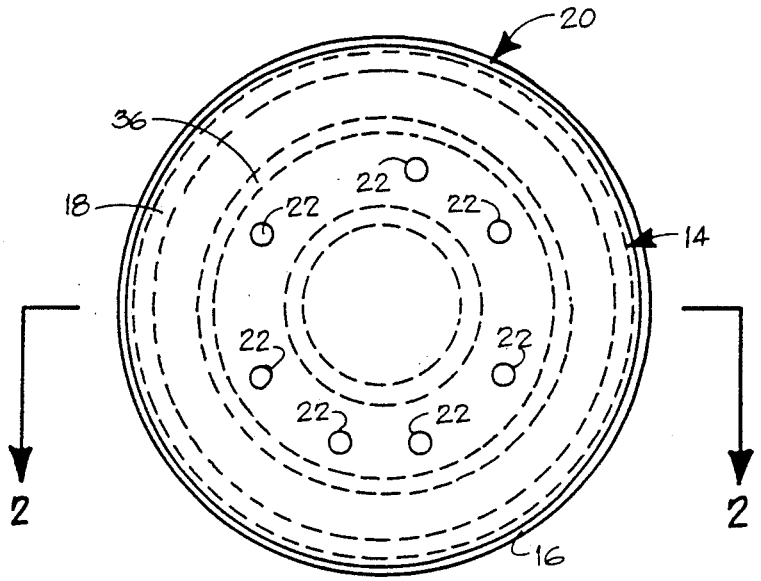
FIG. 1 shows a top plan view of the sewer cover assembly of the present invention.

Referring now to the drawings, the cyndrical sewer catch basin or inlet assembly of the invention is generally indicated by the numeral 14. Preferably the catch basins of the invention are made of a high strength material such as steel. Sewer catch basin assembly 14 is preferably provided with an annular lip 16 which rests upon the surrounding ground or pavement 42.

Lip 16 of inlet 14 defines an opening in the top of inlet 14 through which sewage and other liquids may pass. Lying on top of lip 16 is removable cover 20 which is preferable a flat circular disc having a series of channels or openings 22 therein through which liquids may flow downwardly into the interior of catch basin 14. Cover 20 is a common sewer inlet cover which lies on top of the sewer inlet and is held in place by gravity.

At the bottom end of catch basin 14 is a trough generally indicated by the numeral 24. Trough 24 is defined by horizontal annular plate 26 connected to vertical wall 18 of catch basin 14. Connected to annular plate 26 perpendicularly thereto is interior cylindrical wall 28. Trough 24 thus defines a compartment extending completely around the interior of catch basin 14 into which the water or other liquids may drain and be contained.

Figure 2:
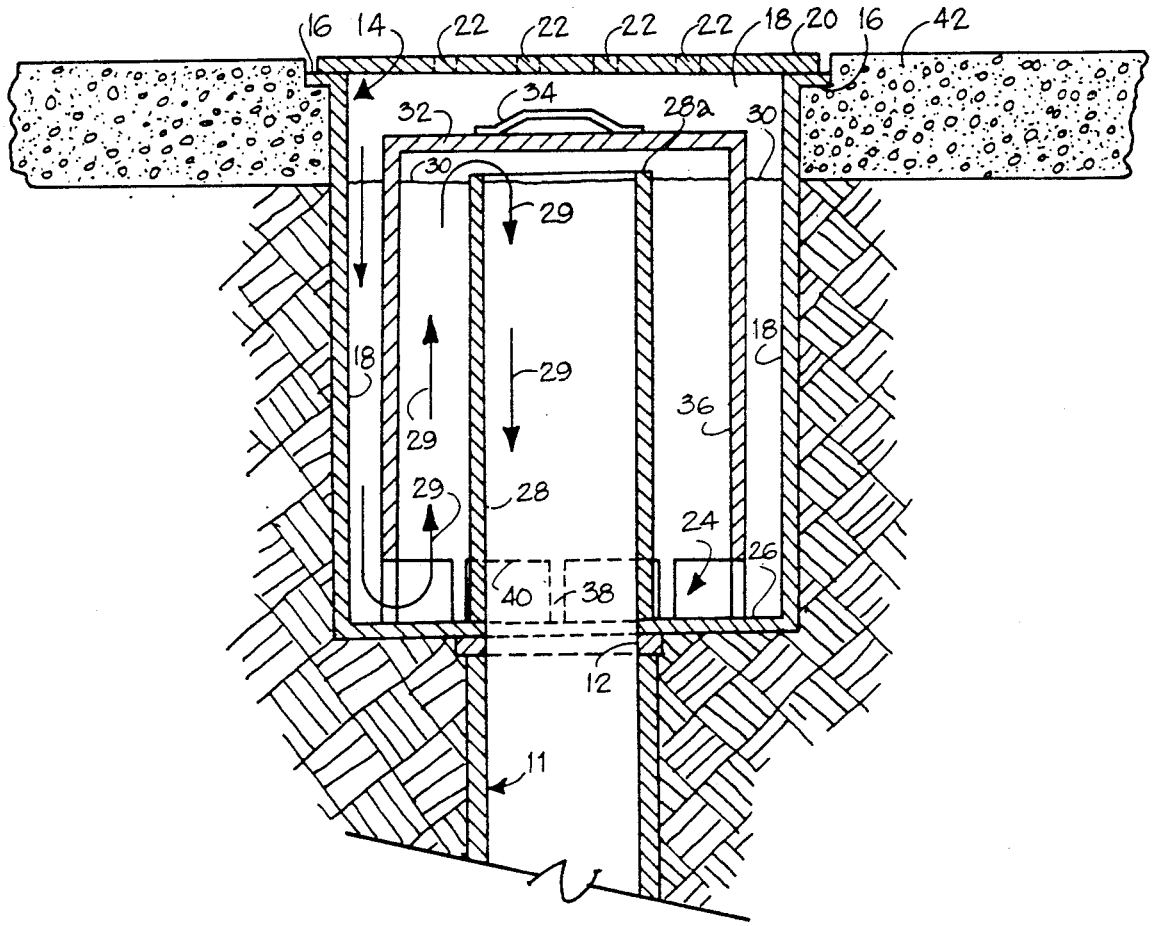
FIG. 2 is a cross sectional view of the sewer cover assembly of the present invention taken along lines 2–2 of FIG. 1.

As can be seen in FIG. 2, the height of interior wall 28 is less than the height of external wall 18 of catch basin 14. The inner diameter ~~of the~~ cylindrical walls 28 may be chosen to match the inner diameter of vertical sewer pipe 11, or the inner diameter or 28 may be larger or smaller than the inner diameter of 11. The vertical sewer pipe 11 may be connected to annular plate 26 by weld 12, or by any other conventional fastening method.

Figure 3:
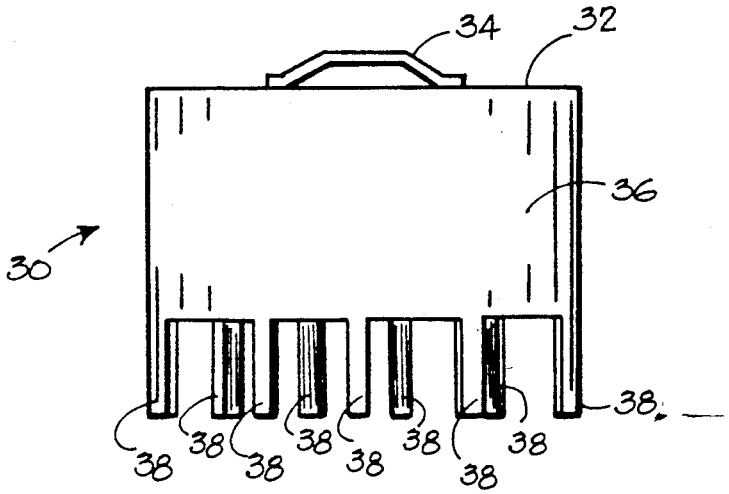
FIG. 3 is an elevational view of the lid shown in FIG. 2.

In FIG. 3 is shown a lid generally indicated by the numeral 30. Lid 30 has a horizontal top plate 32 which is circular in shape and has handle 34 connected thereto. Extending perpendicularly down from the perimeter of circular top 32 is vertical exterior wall 36 of lid 30. Wall 30 has a series of supports 38 connected at the bottom thereof support wall 36 at a desired distance above the annular plate 26 through trough 24. The bottom edge 40 of lid 30 lies beneath the top edge **28*a* of trough 24**.

Thus, when trough 24 is filled with water traveling downwardly through openings 22 of cover 20, water will rise to the level 30 equal in height to the top edge **28*a* of trough 24, and will flow over the edge 28*a* through the opening defined by interior wall 28 of trough 24 in a direction indicated by the arrows 29 and downwardly to the vertical sewer lines 11 connected to the base of sewer catch basin 14. Vertical pipe 11** can be connected to a horizontal sewer pipe(not shown) by a "Tee" pipe connection as is well known in the art.

The supports 38 for holding lid 30 may be of any desired design as long as the bottom edge 40 of the exterior wall 36 of lid 30 is above annular plate 26 and beneath the top edge 28*a* of vertical wall 28 of trough 24.

If it is desired to clean the catch basin 14 or to place equipment downward in catch basin 14, cover 20 may be removed and lid 30 may be removed through the use of handle 34, thereby exposing the opening defined by vertical wall 28.

Although the preferred embodiments of the present invention have been disclosed and described in detail above, it should be understood that the invention is in no sense limited thereby, and its scope is to be determined by that of the following claims:

What is claimed is:

1. A catch basin assembly connectable to a vertical inlet pipe to a sewer for preventing gases from escaping from the sewer through the catch basin comprising:

a. catch basin means having a top end for receiving sewage and having a bottom end means for connection to a vertical inlet pipe connected to a sewer of a petroleum refinery or chemical processing plant, said catch basin means having i. generally vertical walls on the exterior thereof, ii. trough means at said bottom end of said catch basin means and extending completely around the interior of said generally vertical walls of said catch basin means for containing water received in said catch basin means, iii. an inner generally vertical wall connected to said trough means defining a top opening through which liquids overflowing from said trough means can flow and a bottom opening through which said liquids overflowing from said top circular opening can exit, said inner generally vertical wall of said trough means having a height less than the height of said generally vertical wall of said catch basin means, c. lid means lying in said trough and over and around said top opening to prevent gases from traveling through said opening when said trough means is filled with water while permitting said liquids to flow through said top opening, d. cover means lying on top of said catch basin means, said cover means having a plurality of channels therein through which said liquids may flow into said catch basin means, and e. said vertical inlet pipe of said sewer being connected to said bottom opening of said inner generally vertical wall for conveying liquid overflowing from said trough means to said sewer.

2. The catch basin assembly of claim 1 wherein said cover means is a circular disc having a series of holes therethrough.

3. The catch basin assembly of claim 1 wherein a handle means is connected to the top of said lid means for removing said lid means from said trough means.

4. The catch basin assembly of claim 1 wherein said trough means has a generally horizontal bottom.

5. The catch basin assembly of claim 4 wherein support means are connected to said lid means for supporting said lid means above said bottom of said trough means.

6. The catch basin assembly of claim 5 wherein said generally horizontal bottom of said trough means is connected to the bottom end of said inner generally vertical wall of said trough means.

7. The catch basin assembly of claim 6 wherein said generally horizontal bottom of said trough means is connected to the bottom end of said generally vertical exterior walls of said catch basin means.

8. The catch basin assembly of claim 1 wherein said lid means has a generally horizontal top means having generally vertical exterior walls extending downwardly therefrom.

9. The catch basin assembly of claim 8 wherein said generally vertical walls of said lid means have a plurality of openings in the lower portion thereof through which water may flow.

10. The catch basin assembly of claim 1 wherein said catch basin means has lip means around said top end thereof which rests upon the ground or pavement surrounding the catch basin assembly.

* * * * *